United States Patent [19]

Funck

[11] 4,271,607

[45] Jun. 9, 1981

[54] SOLE-UNIT FOR PROTECTIVE FOOTWEAR

[76] Inventor: Herbert Funck, Am Wasserbogen 43, 8032 Grafelfing-Lochham, Fed. Rep. of Germany

[21] Appl. No.: 64,795

[22] Filed: Aug. 8, 1979

[30] Foreign Application Priority Data

Sep. 4, 1978 [DE] Fed. Rep. of Germany ..... 2838522

[51] Int. Cl.[3] ..... A43B 13/12; A43B 13/04

[52] U.S. Cl. ..... 36/30 R; 36/32 R; 36/72 R; 36/107

[58] Field of Search ..... 36/30 R, 32 R, 107, 36/72 R

[56] References Cited

U.S. PATENT DOCUMENTS

| | | | |
|---|---|---|---|
| 1,566,364 | 12/1925 | Blair | 36/30 R |
| 3,553,857 | 1/1971 | Pettit et al. | 36/32 R |
| 4,044,479 | 8/1977 | Brutting | 36/32 R |

FOREIGN PATENT DOCUMENTS

| | | | |
|---|---|---|---|
| 2042870 | 2/1973 | Fed. Rep. of Germany | 36/32 R |
| 2610076 | 9/1977 | Fed. Rep. of Germany | 36/30 R |
| 2643237 | 4/1978 | Fed. Rep. of Germany | 36/30 R |
| 2250266 | 11/1978 | France | 36/30 R |
| 7114808 | 5/1972 | Netherlands | 36/32 R |

*Primary Examiner*—James Kee Chi

*Attorney, Agent, or Firm*—Haseltine and Lake

[57] ABSTRACT

A sole-unit for protective footwear comprising a prefabricated tread sole of a heat resistant plastic material, for example of nitrile rubber, with open-top cavities in the heel region and a steel plate inlay in a region directly beneath the inner sole of the upper shoe.

3 Claims, 2 Drawing Figures

SOLE-UNIT FOR PROTECTIVE FOOTWEAR

This invention relates to a sole-unit for protective footwear of the kind comprising a prefabricated tread sole, in particular made of a heat resistant plastics material, e.g. nitrile rubber, and provided with upwardly open-ended cavities in the heel region thereof.

Within the general range of protective footwear the safety boot for the building industry occupies a special place in as much as, additionally to the steel toe cap, it is required to incorporate in its infrastructure a pierce-proof sole-shaped inlay the properties of which, as well as its position and dimensions are regulated by German Industrial Standard specification DIN No. 4843. Nowadays this inlay is almost exclusively made of 0.5 mm stainless alloy steel. The positionally accurate fitting and secure fixing of this very thin steel inlay in the infrastructure of the boot or shoe present considerable difficulties to the shoe manufacturers for which reason it is becoming increasingly more customary to make use of prefabricated sole-units wherein the steel inlays are positionally accurately embedded in the sole material during manufacture of the unit.

In a conventional sole unit of this kind the steel inlay is embedded in the polyurethane foam sole in the uppermost region thereof by casting or injection moulding methods. The chief advantage of this type of unit resides in that after the sole unit has been secured to the boot or shoe the pierce-proof inlay is everywhere quite closely beneath the top insole. This, in the first place, achieves maximum safety and protection for the wearer because the inlay is also capable of warding off any piercing objects which penetrate obliquely from the outside into the sole. Secondly, the tensions which are created in the region of the ball of the foot due to the flexing and bending of the shoe in this region are kept as low as possible thanks to the very closeness of the steel inlay to this bending zone. The main drawback of these sole units, on the other hand, resides in that they can only be made from a "PUR" foam material with very light specific gravity. This is a thermoplastic material and consequently has only limited resistance to heat. Heat resistance is however frequently a very important feature in protective footwear for the building industry especially when worn on road construction and other high temperature working sites.

A vulcanised nitrile rubber is a particularly well suited material for the soles of builder's safety boots which is capable of satisfying every requirement, including that of withstanding high temperatures. However, with this material it is not possible to vulcanise the steel inlay in the uppermost region of a one-piece sole-at least not in the heel region thereof because the heels of such sole units must be hollow in view of the high specific gravity of the compacted nitrile rubber. The integral moulding or forming of a hollow heel beneath an upper steel sole on the other hand is not possible with currently available technology. Nor can the problem be solved with the aid of prefabricated hollow elastic filler pieces which might be inmoulded in the heel beneath the steel sole, because these would be destroyed under the very high vulcanising pressure.

With the aim of providing prefabricated sole units of nitrile rubber or other vulcanisable elastomeres for builder's safety boots inspite of these problems a steel inlay which was angled downwardly along the heel front of the sole and rearwards at the lower end of the heel was vulcanised into the sole in such a way as to be as closely as possible to the top surface of the sole in the ball of the foot region thereof whilst extending in the lower part of the sole, near the tread surface thereof in the heel region, where there are no more bending stresses. Thus it became possible in the heel part which was approximately 25 mm thick to form a hollow heel above the steel sole in the conventional way by vulcanising an outer edge or rim portion and central webs, thereby achieving the desired elasticity as well as the necessary weight reduction. Whilst these soles are universally applicable to protective foot wear for the building industry they nevertheless constitute a certain safety hazard to the wearer, for if a nail should penetrate obliquely from the side into the heel wall of the heel portion, the pierce-proof inlay cannot provide any protection because it is below such penetration point and the wearer's foot may be seriously injured.

Moreover, both of the above described and currently widely used prefabricated soles with steel inlays incorporated therein by foam-moulding or vulcanising have another and serious disadvantage in common: they are exclusively intended and suitable for builder's safety boots and for this reason the shoe manufacturer may keep a second type of prefabricated sole unit without steel inlay in stock for ordinary protective footwear other than regulation builder's safety boots.

It is the aim of the present invention to provide a sole unit of the kind specified which affords fully effective anti-piercing protection in all regions thereof, including the heel region but which requires only one basic or standard model to be prepared or moulded and kept in stock for various types of protective footwear.

The effective solution to the underlying problem of this invention is based on the idea of making the actual walking or tread-sole separately and designing it in such a way that a simple, approximately plane sheet steel inlay of the kind generally fitted in "PUR" soles, may be easily incorporated in the pre-formed tread sole if desired. According to this invention, therefore, locating means are provided in the upper part of the tread sole for the optional fitting and fixation of a continuous, approximately plane and pierce-proof sheet steel inlay.

This sole-design according to the present invention has the advantage that the pierce-proof sheet steel inlays can be simply fitted and fixed in otherwise preformed standard tread soles where the sole is intended for application to builder's safety boots. This means that the shoe manufacturer is obliged to keep only one standard type of sole and separate, loose steel inlays in stock and by selective fitting of such steel inlays he can make only those safety boots pierce-proof which have to satisfy specific regulations and requirements. The new sole-unit also offers considerable advantages to the sole-maker. He may now produce the tread soles without inlays from the desired material without risk of major scrap or wastage in shorter production cycles so that the soles according to this invention could be cheaper than those with sheet steel inlays incorporated therein by foam-moulding or vulcanising processes.

A preferred design for the locating means for the inlays is based on the consideration that with modern adhesive sole joints a substantial width of 15 to 20 mm for the adhesive joint is required only along the edge or welt of the sole in the toe and ball regions of the foot where the shoes are flexed when worn. In the instep and heel regions, on the other hand, where the shoes, when worn, are essentially subjected to static loads only, the marginal adhesive joint areas need be no wider than half the above mentioned width, or even less. For the prescribed inlay size and taking into account the widths of the marginal adhesive joint regions the locating means are formed in the margin or edge of the tread sole in the toe and ball regions of the foot as horizontal grooves which extend from the inside towards the outside and in the heel and instep regions of the tread sole the locating means are in the form of a recess of depression. The sheet steel inlay is fitted in the sole by sliding its foremost point from the rear end beneath the lip mouldings of the open-ended groove, which may be done with the aid of a fitting tool, where desired, by means of which the said lip moulding is raised up by bending the forward part of the sole. After insertion of the inlay into the forward groove the rearward inlay part is pressed down from the top into the depression or recess which is precisely form- matched therewith.

In order to facilitate insertion of the inlay into the groove the lip moulding which constitutes the upper boundary wall of the horizontal groove may comprise at least one break or interruption, preferably in the toe region so that the inlay can be slid obliquely from the rear first beneath one lip moulding part and then the other lip moulding part can be pushed over the edge of the inlay.

Positional fixation of the inlay may be further improved by providing an on-moulded inwardly projecting narrow deformable lip along the outline edge of the recess or depression in the heel and instep regions of the tread sole. The upwardly projecting part of this lip should be so short that the pierce-proof inlay can be pushed from above into the slot defined by the narrow lip. This provision affords an easy way of locating and fixing the steel inlay also in the heel recess and creates no potential obstruction in the course of further treatment or processing of such soles in the shoe-making process.

In order to avoid that after prolongued wear and under the repeated bending and flexing of the safety boot in the ball of the foot region thereof the steel inlays might slowly creep forwards and their sharp edges cut into the infrastructure at the toe of the boot, a preferred embodiment of the invention is characterised in that the frontal horizontal groove together with the rear recess or depression up to the middle of the sole is precisely matched in outline to the outline of the steel inlay and that the said groove is deeper towards the point or toe of the sole than the outline of the inlay. In this embodiment of the invention the inlay is firmly located by virtue of the exact contour matching of the middle recess and the rearward part of the deep groove in the heel and instep region of the rearward part of the shoe which is subject to static loads only in as much as the constricted neck portion in the instep region largely precludes any slipping or dislocation in the longitudinal direction. The somewhat larger contour of the groove in the toe and ball region of the foot allows for unequal length variation between metal inlay and tread sole when the foot of the wearer flexes the shoe without permitting the sharp inlay edges cutting into the tread sole at the toe point. Such sliding freedom of the foremost point of the inlay within the locating groove also has a beneficial effect with regard to the permanent bending strength of the inlay and improves the general flexibility of any footwear equipped with this type of sole.

Secure fixation of the inlay relative to the tread sole may be still further improved by providing at least one lug projection on the underside of the inlay in the heel part thereof which lug engages in a corresponding cavity of the moulded heel.

The risk of a premature destruction of the sole edge in the region of the toe or point of the shoe can be reduced also by arranging a reinforcing insert, e.g. a cord strip, in the rim or edge portion of the sole either by securing this insert directly to the marginal edge of the inlay prior to fitting of the latter or by embedding the inset in the tread sole material, as by inmoulding or vulcanising.

Some embodiments of the invention are hereinafter more specifically described with reference to the accompanying drawings wherein.

Figure 1:
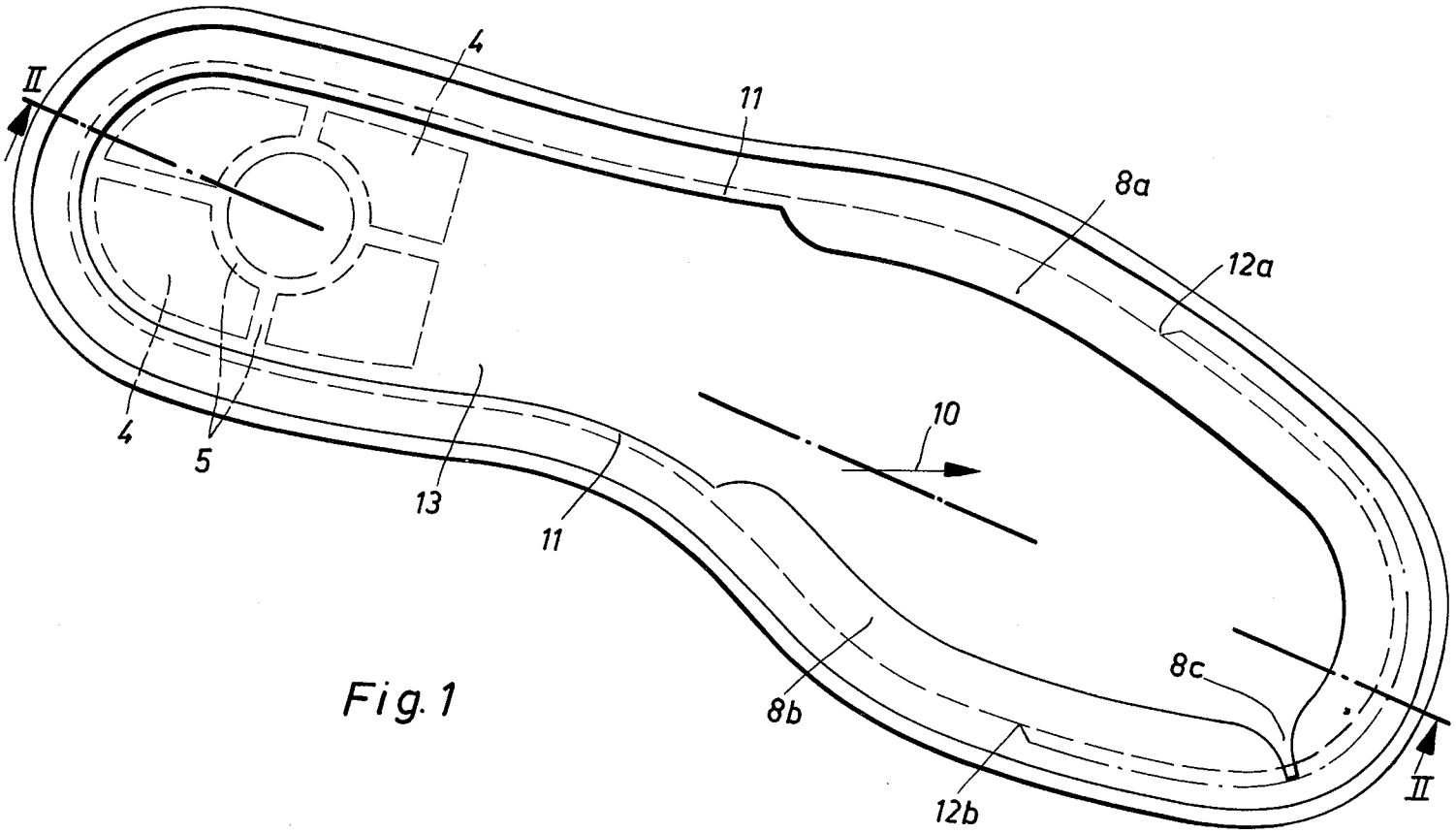
FIG. 1 is a top view of a sole-unit.

The illustrated sole-unit comprises a tread sole 1 preferably made from a vulcanisable plastics material of relatively high heat resistance, and a pierce-proof inlay 2 in the shape of a plane piece of sheet steel matched in form to the tread sole. In the frontal, ball of the foot and toe region as well as in the heel region thereof the tread sole 1 comprises a profiled walking tread 3 and in the heel there are several cavities 4 for weight reduction which are relatively separated by an annular and four radial, vertically extending web or strip portions 5. For improved adhesion of this sole to the upper of the shoe or boot the sole is provided with a continuous raised rim or edge 6 (welt) with a curved inside wall 7.

Figure 2:
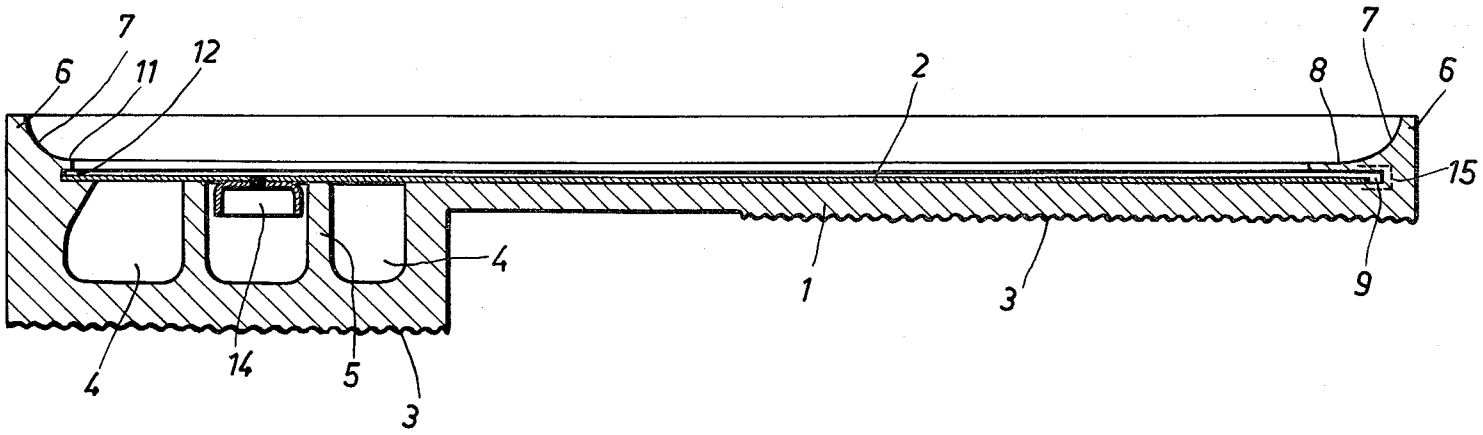
FIG. 2 is a longitudinal section taken on line II—II in FIG. 1.

The pierce-proof sheet metal inlay 2 is fitted or built into the prefabricated tread sole 1 as and when required. For locating and positionally securing the metal inlay 2, the moulded tread sole 1 comprises in its ball- and toe-region a lip moulding **8*a*,8*b* which projects into the interior of the shoe and forms the upper boundary wall of a horizontal slot 9 (FIG. 2). In the embodiment shown in FIG. 1 this lip moulding 8*a*,8*b* has a break 8*c* in the region of the toe of the sole which facilitates the insertion of the pierce-proof metal inlay 2 which latter, in this case, is first inserted in direction of arrow 10 in FIG. 1 into the slot below the lip 8*a*. The lip moulding 8*a*,8*b* which forms the upper boundary wall for the deep horizontal groove 9 terminates just behind the ball region of the sole where it merges into a narrow horizontal marginal edge strip 11 which extends at a constant width over the whole rearward part of the sole and forms the upper boundary wall of a narrow slot 12 which is exactly contour-matched to the outline of the metal inlay 2**.

Up to the points marked **12*a* and 12*b* the contour of the horizontal groove 9 which is bounded by the lip moulding 8*a*,8*b* coincides exactly with the contour of the pierce-proof inlay so that the latter is secured against slipping in the longitudinal direction by the constriction in the instep region 13 of the sole. However, from points 12*a*,12*b* onwards the inner contour of the groove 9 in the toe region of the shoe is somewhat larger than the outside contour of the metal inlay 2 to allow a limited amount of relative movement of the tread sole relative to the non-extendable and non-stretchable inlay. Further positional fixation of the inlay 2 is provided by a cup-shaped holder 14 shown in FIG. 2 which is secured to the underside of the metal inlay 2 and projects from the top into the central circular cavity 4 of the heel. In this embodiment the holder part 14 is a round, cup-like metal part which is welded or rivetted to the sheet metal inlay 2. Its diameter corresponds approximately to the diameter of the central heel cavity thereby providing a large contact engagement area between this holder part and the walls of the heel recess or cavity for good force and load transmission. For the purpose of further securing and fixation of the metal inlay 2 in the shoe an insert 15, e.g. in the form of a fabric strip is incorporated by vulcanising or in moulding in the toe region of the sole edge or rim, directly adjacent to the groove 9, which prevents the sharp edge of the inlay 2 cutting into and through this forward edge of the sole. Alternatively the reinforcing element 15** may be arranged and secured directly around the frontal edge of the sheet metal inlay.

The described sole unit is suitable for application to protective footwear of widely different types. Thanks to the facility of fitting the plane sheet metal inlay in the upper region of the tread sole a high measure of pierce-proofing is achieved, as is required, for example in regulation safety footwear for the building industry, for the metal working industries and others. For safety boots which are to be worn on hot sites it is advisable to select nitrile rubber or the like as tread sole material whilst for work on sites which are not affected by thermal problems other materials, including foamed materials such as "PUR" may be used for the moulded tread soles of the safety boots.

I claim:

1. A prefabricated tread sole of a heat resistant plastic material, for example of nitrile rubber, for pierce-proof protective shoes, having a loosely embedded steel plate inlay in a region directly beneath the inner sole of the upper shoe, wherein: the sole region is defined by an uncoated steel plate inlay surrounded by a horizontal lip, having a horizontal groove formed as a mounting support of the periphery of the steel plate inlay, whose depth is exactly fitted in the heel and middle sole portion to the rim of the steel plate inlay and in the instep region and the sole tip of the lip being widened to the inside of the shoe and with the region of the sole tip having the groove deeper, so that the rim of the steel plate inlay is away from the bottom of the groove.

2. A tread-sole according to claim 1, wherein: familiar openings are provided in the heel region and that a fastened projection on the underside of the steel plate inlay projects for additional stability of the steel plate inlay in at least one of the openings.

3. A tread-sole according to either claims 1 or 2, wherein: in the rim of the sole there is provided an insert strengthening the base of the groove.

* * * * *